US005993368A

United States Patent [19]

Benovitz et al.

[11] Patent Number: 5,993,368

[45] Date of Patent: Nov. 30, 1999

[54] APPARATUS FOR MANUFACTURING SHIPPING POUCHES

[75] Inventors: Lee Benovitz; Harry Morris; Rex Poole, all of Louisville, Ky.; Willis Huff, Pekin, Ind.

[73] Assignee: Ohio Valley Bag and Burlap Company, Louisville, Ky.

[21] Appl. No.: 09/150,386

[22] Filed: Sep. 9, 1998

[51] Int. Cl.[6] ..... B31B 1/64

[52] U.S. Cl. ..... 493/198; 493/200; 493/196

[58] Field of Search ..... 493/194, 195, 493/196, 197, 198, 199, 200, 201, 203; 53/559, 562

[56] References Cited

U.S. PATENT DOCUMENTS

| | | | |
|---|---|---|---|
| 2,257,823 | 10/1941 | Stokes . | |
| 2,633,286 | 3/1953 | Claridge et al. . | |
| 3,044,369 | 9/1962 | Ross . | |
| 3,133,480 | 5/1964 | Gerard . | |
| 3,194,124 | 7/1965 | Warp | 493/198 |
| 3,350,988 | 11/1967 | Schultz . | |
| 3,411,419 | 11/1968 | Becker et al. . | |
| 3,552,278 | 1/1971 | Guenther . | |
| 3,576,154 | 4/1971 | Lengerich . | |
| 3,682,051 | 8/1972 | Sengewald . | |
| 3,783,750 | 1/1974 | Heimeijer . | |
| 4,232,589 | 11/1980 | Ernst . | |
| 4,285,681 | 8/1981 | Walitalo . | |
| 4,337,058 | 6/1982 | Lerner . | |
| 4,378,223 | 3/1983 | Branecky et al. . | |
| 4,395,255 | 7/1983 | Branecky et al. . | |
| 4,500,307 | 2/1985 | Bridgeman . | |
| 4,530,732 | 7/1985 | Horn . | |
| 4,642,084 | 2/1987 | Gietman, Jr. . | |
| 4,726,169 | 2/1988 | Achelpohl et al. . | |
| 4,751,121 | 6/1988 | Kühnel et al. . | |
| 4,895,753 | 1/1990 | Etter . | |
| 5,080,747 | 1/1992 | Veix | 493/200 |
| 5,215,275 | 6/1993 | Gold . | |
| 5,417,639 | 5/1995 | Cronauer . | |
| 5,549,538 | 8/1996 | Marsik . | |
| 5,585,179 | 12/1996 | Nishiyama . | |

*Primary Examiner*—Stephen F. Gerrity
*Assistant Examiner*—Steven Jensen
*Attorney, Agent, or Firm*—Wheat, Smith, Beres, PLC; Joan L. Simunic; Vance A. Smith

[57] ABSTRACT

The present invention is an apparatus for manufacturing interconnected, easily separable, protective pouches, made from heat-sealable material, and adapted to enclose and protect objects. The pouches are made by feeding a continuous sheet of heat-sealable material through a folding unit, folding the material approximately in half, perforating and heat-sealing the sheet across the width of the sheet, moving the sheet downstream the length of the opening for the pouch, heat-sealing across the sheet, moving the sheet downstream the length of the edge allowances for the pouch, and repeating the steps until the desired number of pouches have been produced. The finished pouches are collected on rewind rolls.

6 Claims, 8 Drawing Sheets

APPARATUS FOR MANUFACTURING SHIPPING POUCHES

BACKGROUND OF THE INVENTION

The present invention relates to a method and apparatus for manufacturing interconnected, easily separable, protective pouches, made from heat-sealable material, and adapted to enclose and protect objects.

To protect objects or parts which can be particularly susceptible to damage from abrasive contact with other parts or with shipping containers, the parts may be wrapped or enclosed in protective material prior to shipping. One technique is to use individual pouches, with wide openings, to enclose the parts. The pouches can be made by cutting various predetermined widths and lengths of material, assembling the material to form a pouch, and sewing the edges together. However, the cutting and sewing process to form such pouches is labor-intensive and the sewn seams can easily snag on the corners of the parts being covered, resulting in unraveled seams. In addition, because the pouches are supplied as individual units, packing of the pouches for shipment to the parts manufacturer can be labor-intensive, and the individual pouches can become tangled and unwieldy to manage during use.

There have been numerous attempts in the prior art to address the aforementioned problems. However, they have not been applied in toto to develop an efficient continuous process for producing pouches for large parts.

For example, U.S. Pat. No. 3,682,051, issued to Sengewald, and U.S. Pat. No. 4,500,307, issued to Bridgeman, teach that pouches can be made from a flat tube by perforating the tube across the tube, then heat-sealing across the tube. The resulting pouches are interconnected, have single seal lines across the width of the tube, and openings approximately equal to the width of the flat tube. The pouches can be separated by tearing at the perforations near the seal line. But, the size for the openings on the pouches are restricted to the width of the tube.

U.S. Pat. No. 3,552,278, issued to Guenther, teaches using prefolded material to manufacture pouches which leave an open edge along the length of the material and which are perforated between two separate and distinct heat seals. Guenther teaches that the two heat seals are made in a single step by using a sealer with parallel sealing edges. The resulting pouches are interconnected, have openings that can be varied in length, and can be separated by tearing at the perforations near the seal line. However, one cannot start with a single-ply sheet of material to make these pouches.

It is therefore a paramount object of the present invention to provide a cost efficient method for manufacturing interconnected pouches for parts, without cutting the material and forming stitched seams, starting with a single-ply sheet of material.

SUMMARY OF THE INVENTION

The present invention relates to a method for manufacturing interconnected, easily separable, protective pouches, made from heat-sealable material, and adapted to enclose and protect objects. The pouches made in accordance with the present invention are manufactured from a continuous sheet of material, and the individual pouches are separable by perforations provided between the pouches.

The process begins with a heat-sealable material provided as a single-ply sheet. As the sheet moves downstream, the sheet is folded approximately in half to form a two-ply folded sheet, having a fold along one side and open edges opposite the fold. At a first stop position, a first heat-seal and perforations are made across the folded sheet, substantially simultaneously, such that the heat-seal is positioned upstream relative to the perforations. The sheet is then moved downstream by a distance equal to the length of the opening for the pouch where objects will be inserted into the pouch. At a second stop position, a second heat-seal is made across the sheet. The sheet is moved downstream by a distance equal to the total length of the edge allowances for a single pouch. The forward movement of the folded sheet is then stopped at the first stop position. The first stop-move-second stop-move steps are repeated until the desired number of pouches have been produced. The interconnected pouches are collected on rewind rolls. A microprocessor controls the start and stop sequences for inverter controls that regulate the rate and degree of forward movement of the sheet, and the timing sequences for making the heat seals and perforations.

The apparatus of the present invention comprises a plurality of material feeding units with brakes designed to control material flow to the folding units, a plurality of folding units appropriately positioned to permit the manufacture of a plurality of rolls of pouches simultaneously, a heat-sealing unit, a perforating unit, and a material rewind station.

DETAILED DESCRIPTION OF THE INVENTION

Figure 2:
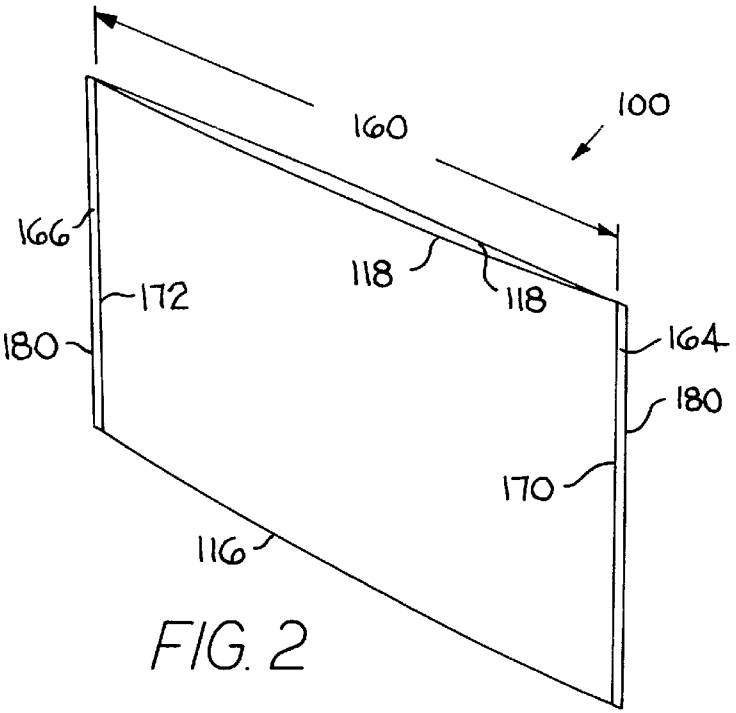
FIG. 2 shows a pouch separated from a roll of interconnected pouches.
Figure 1:
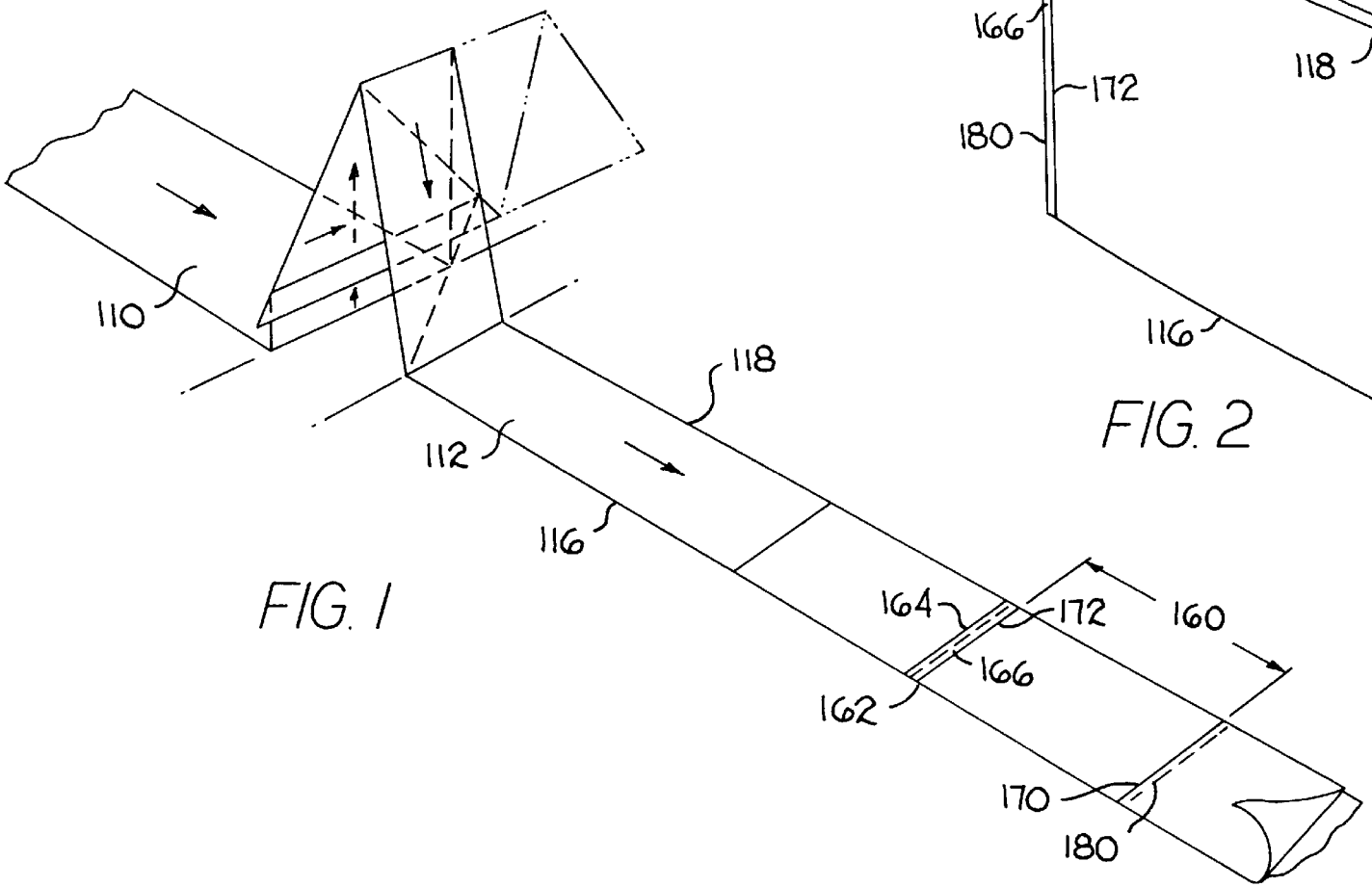
FIG. 1 is a schematic view of interconnected pouches manufactured in accordance with the invention.

FIGS. 1 and 2 show a schematic view of interconnected pouches 100 manufactured in accordance with the invention and a pouch 100 resulting therefrom. As shown in FIG. 1, the process begins with a heat-sealable material provided as a single-ply sheet 110. As the sheet moves downstream, the sheet is folded approximately in half to form a two-ply folded sheet 112, having a fold 116 along one side and open edges 118 opposite the fold. At a first stop position, a first heat-seal 170 and perforations 180 are made across the folded sheet 112, substantially simultaneously, such that the heat-seal 170 is positioned upstream relative to the perforation 180. The sheet 112 is then moved downstream by a distance equal to the length of the opening for the pouch where objects will be inserted into the pouch, or an insert distance, 160. At a second stop position, a second heat-seal 172 is made across the sheet 112. The sheet 112 is moved downstream by an edge allowance distance 162—a distance equal to the total length of the edge allowances 164, 166 (material located between the heat seal and the perforations) for a single pouch. The forward movement of the folded sheet 112 is then stopped at the first stop position. The first stop-move-second stop-move steps are repeated until the desired number of pouches have been produced. The interconnected pouches 100 are collected on rewind rolls.

FIG. 2 shows a pouch 100, having a fold 116, open edges 118, and two heat-sealed edges 170, 172, separated from a roll of interconnected pouches along the perforations 180. When a pouch 100 is separated along the perforations 180, the edge allowance 162 is divided so that a first portion 164 of the edge allowance remains adjacent to the first heat seal 170 and a second portion 166 remains adjacent to the second heat seal 172. The first and second portions 164, 166 of the edge allowance 160 can vary in length relative to each other. In the preferred embodiment shown, the first and second portions 164, 166 are essentially equal.

Figure 3:
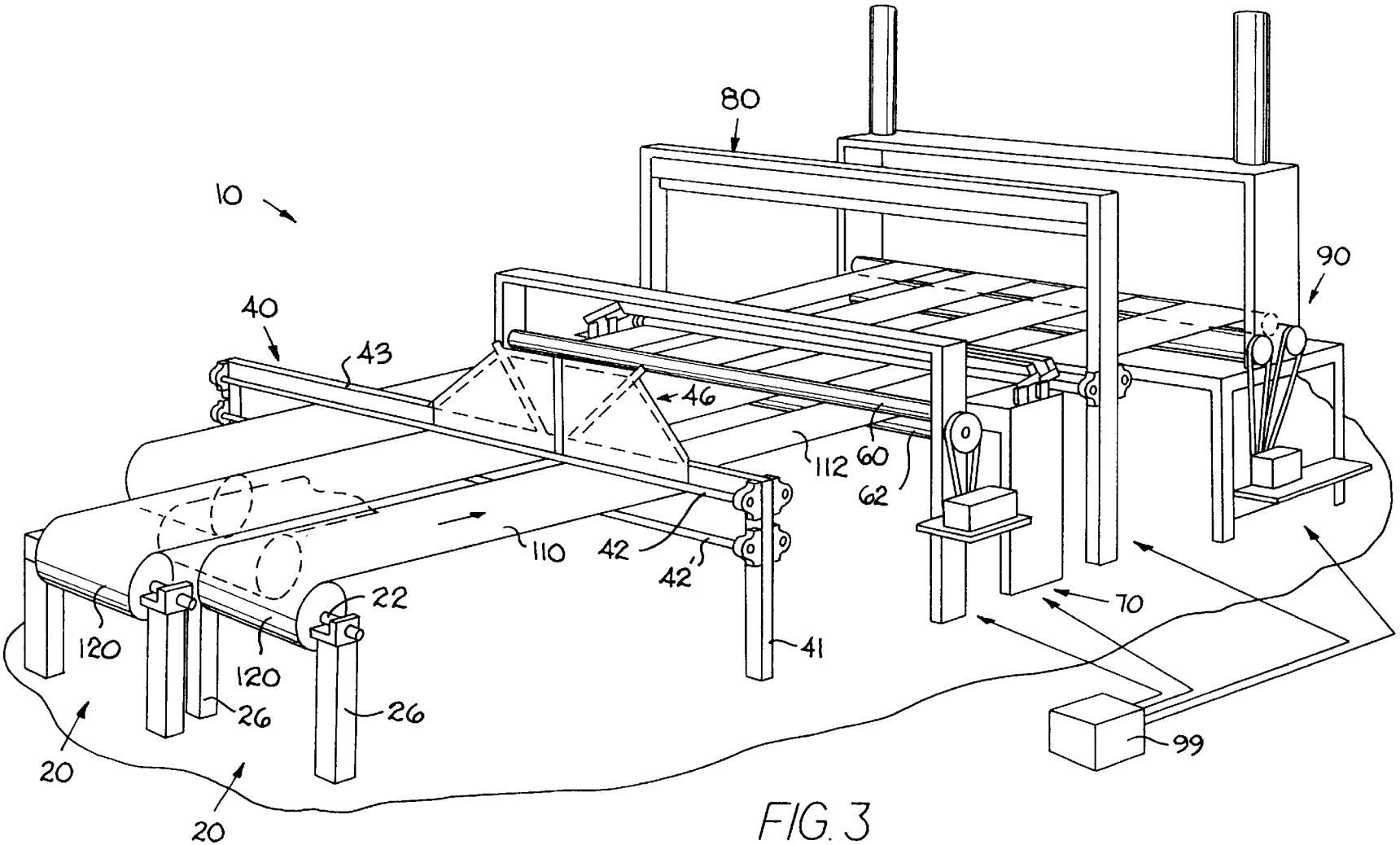
FIG. 3 is a perspective view of the pouch-making apparatus schematically representing the manufacture of the pouches.

FIG. 3 shows a perspective view of the pouch-making apparatus 10. The apparatus comprises a feeder roll station 20, where single-ply heat-sealable material 110 is supplied on feeder rolls 120; a multi-unit folding station 40, where each sheet of material 110 is folded substantially in half along the length of the material; a pair of pinch feed rollers 60, 62, which pull the folded sheet 112 away from the folding station 40; a heat sealing unit 70, where a heat-seal is made across the width of the folded sheet 112; a perforating unit 80, where perforations are made across the width of the folded sheet 112; and rewind station 90, where the interconnected pouches are collected on rolls. A microprocessor or programmbable control unit 99 controls the start and stop sequences for inverter controls at the pinch feed rollers and at the rewind station that regulate the rate and degree of forward movement of the sheet, and the timing sequences for making the heat seals and perforations.

Figure 4:
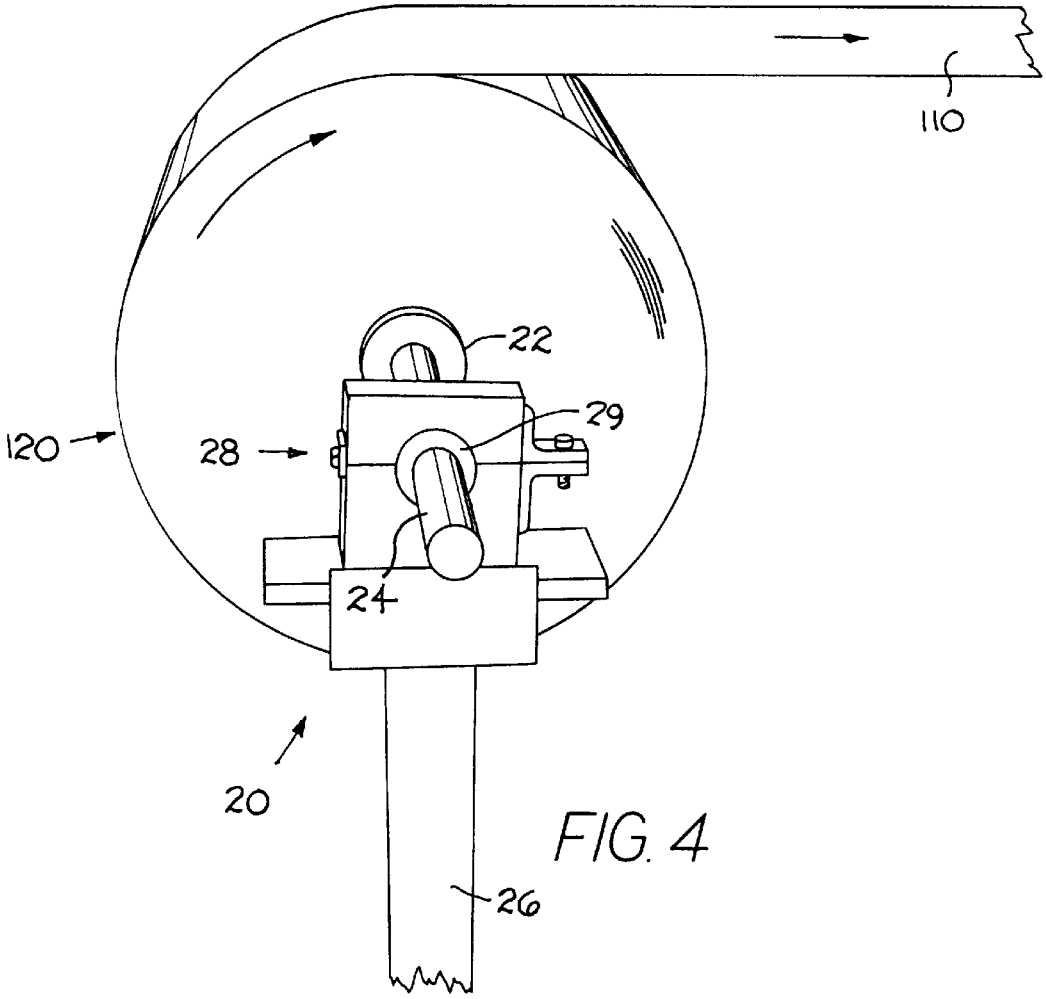
FIG. 4 shows the brake with the feeder roll and feeder roll shaft.

As shown in FIGS. 3 and 4, at the feeder roll station 20 feeder rolls 120 of material are mounted on shafts 22 supported by posts 26. Each shaft 22 has a brake 28 mounted on an end 24 of the shaft 22. The brake 28 serves to keep tension on the material as it feeds toward the folding station 40. This tension is necessary to achieve a complete fold at the folding station 40. A semi-rigid stop 29 keeps the shaft 22 from slipping horizontally during use.

Figure 4A:
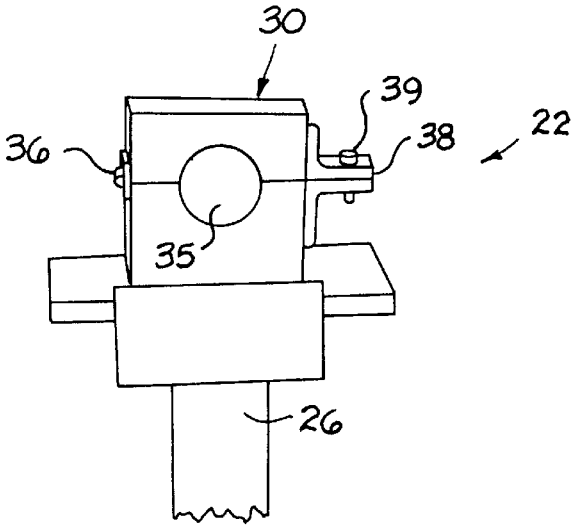
FIG. 4A is a view of the brake without the feeder roll and shaft.

FIG. 4A shows the brake 28 without the feeder roll 120 and the shaft 22. The brake 28 includes a two-piece rigid plastic block 30, the pieces being held together by a hinge 36. When the block 30 is closed, an aperture 35, with a diameter just slightly less than the diameter of the feeder roll shaft 22, is formed. A hasp 38 with a bolt 39 on the face opposite the hinge 36 is used to keep the block closed. When a feeder roll 120 is mounted at the feeder roll station 20, an end 24 of the feeder roll shaft 22 is extended through the aperture 35, and the bolt 39 is manually tightened to cause the block 30 to apply pressure to the feeder roll shaft 22.

A plurality of feeder rolls 120 of material may be used at any one time, the maximum number of feeder rolls being limited only by the width of the material 110 and the length of the pinch feed rollers 60, 62. The material 110 can be any woven or non-woven material that can be fused to itself when exposed to heat and pressure. Some examples of materials that can be used in the present invention include polyethylene, polypropylene, polyester, nylons, or combinations thereof. Single-ply or multi-ply sheet materials may be used. In a preferred embodiment, the material 110 used is a single-ply, non-woven polyethylene with a width of from about 8" to about 144".

Figure 5:
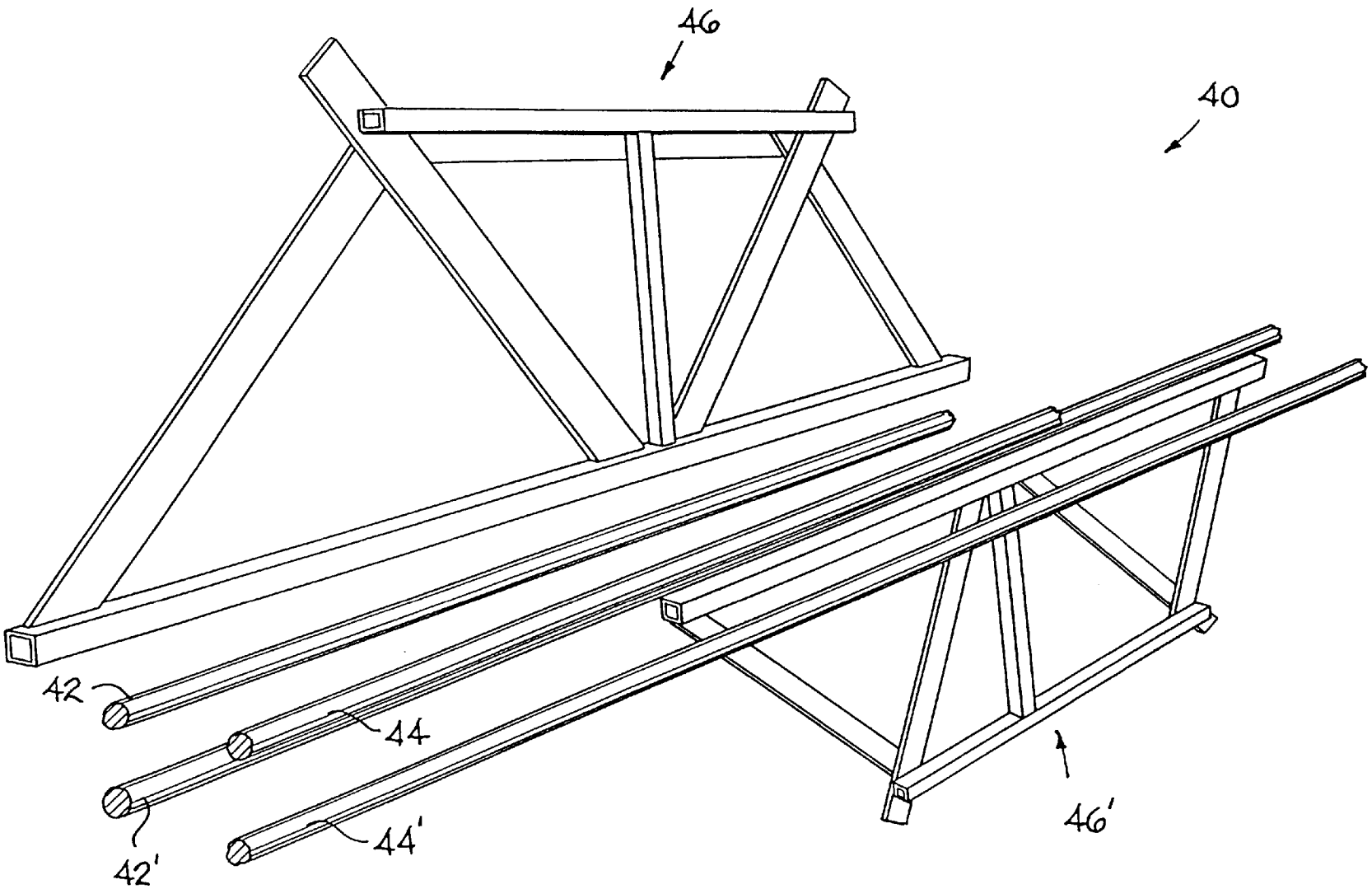
FIG. 5 is a view of the folding station, with two folding units, isolated from supporting structure.

The sheets of material 110 feed from the feeder rolls 120 to a multi-unit folding station 40. As shown in FIG. 3, the multi-unit folding station 40 has individual folding units 46 attached to a support beam 43, which is mounted on legs 41. Alignment bearing shafts upstream 42 of the folding unit and alignment bearing shafts downstream 44 of the folding unit are also secured to the legs 41. Each folding unit 46 is designed to fold up to two separate sheets of material 110 simultaneously. FIG. 5 shows a view of the multi-unit folding station 40 without the material 110, the support beam 43 and the legs 41. As shown, the multi-unit folding station 40 has two folding units 46, 46', although additional folding units may be added as necessary.

Figure 6:
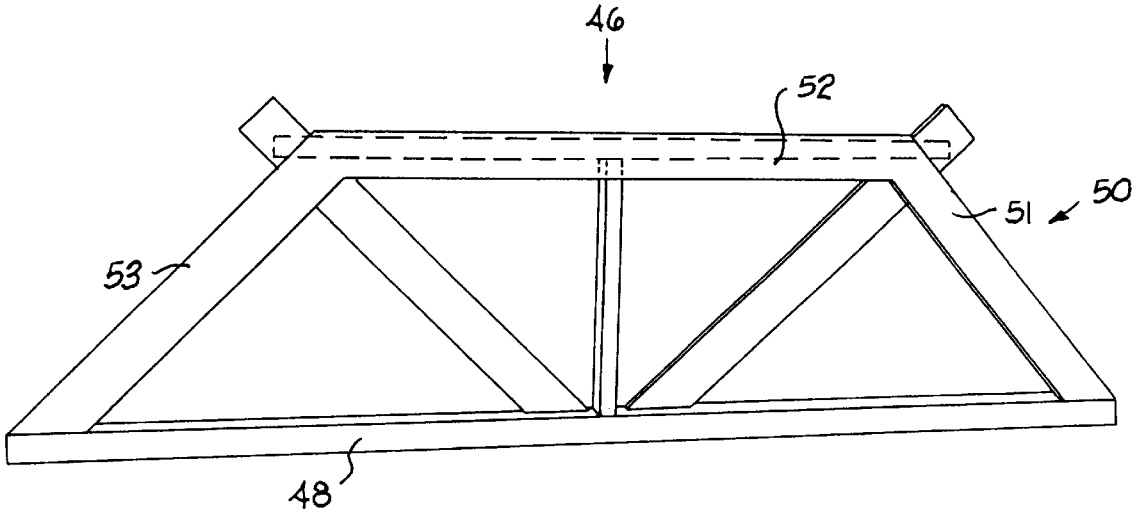
FIG. 6 is an upstream view of a folding unit.
Figure 7:
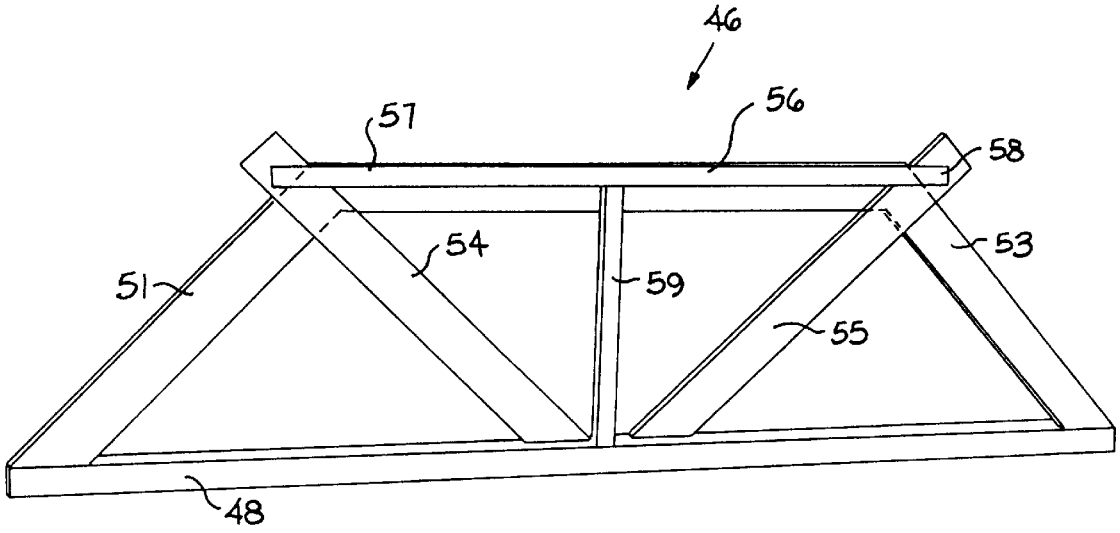
FIG. 7 is a downstream view of a folding unit.

FIGS. 6 and 7 show the upstream and downstream sides of the preferred folding unit, respectively. The folding unit 46 is most easily described as two separate structures attached to the same base 48. The first structure, shown in FIG. 6, is on the upstream side of the base 48. A trapezoid is formed between the base 48, and a folding bar 50, having a first leg 51, a top piece 52, and a second leg 53. The first leg 51 forms an angle of approximately 45° with the base 48, the top piece 52 is substantially parallel to the base 48, and the second leg 53 forms an angle of approximately 45° with the base 48. The trapezoidal structure is on the upstream side of the base 48.

The second structure, shown in FIG. 7, is on the downstream side of the base 48, and includes two internal folding bars 54, 55, a vertical beam 59, and a top beam 56, having ends 57, 58. The internal folding bars 54, 55 are attached to the base 48 and form a "V" centered at the midpoint of the base 48. The angle formed between the first internal bar 54 and the second internal bar 55 equals approximately 60°. The vertical beam 59 is also secured to the base 48, and bisects the angle between the first bar 54 and the second bar 55. The top beam 56 is substantially parallel to the base 48 and is secured to the vertical beam 59 at approximately the midpoint of the top beam 56, with ends 57 and 58 secured to the internal bars 54 and 55, respectively. The folding bar 50 is not attached to the internal folding bars 54, 55, to the top beam 56, or to the vertical beam 59, other than by sharing base 48.

Figure 8:
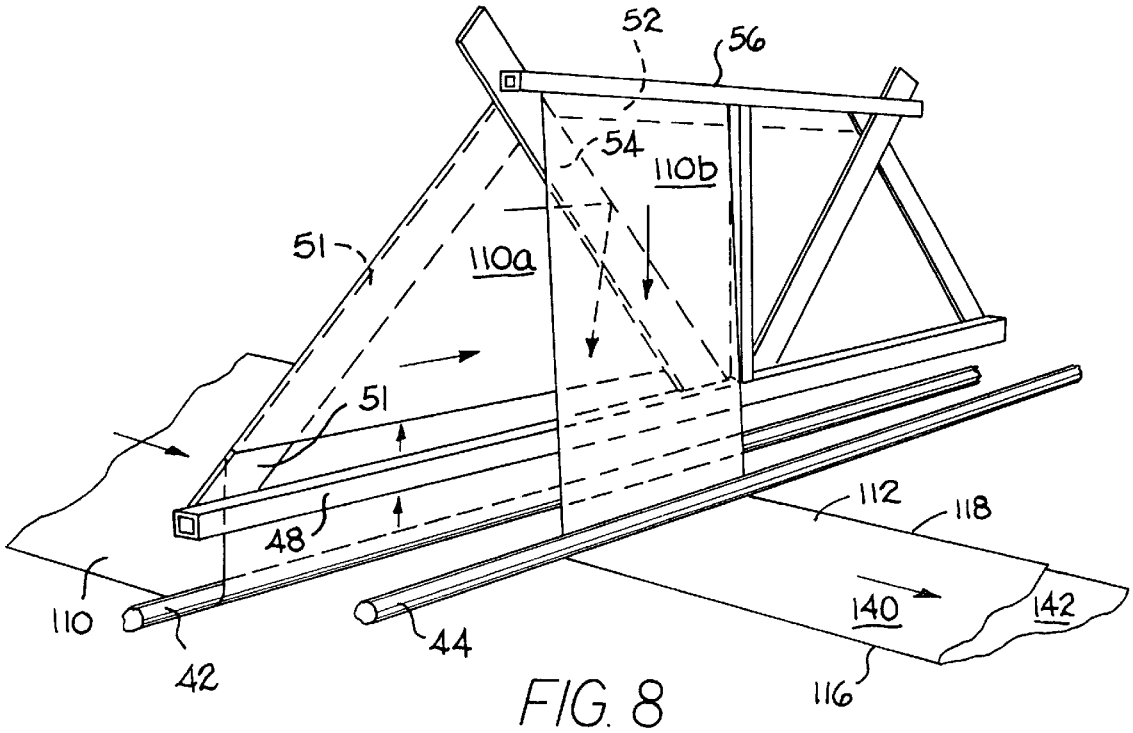
FIG. 8 shows a sheet of fabric being folded on a first side of a folding unit.
Figure 9:
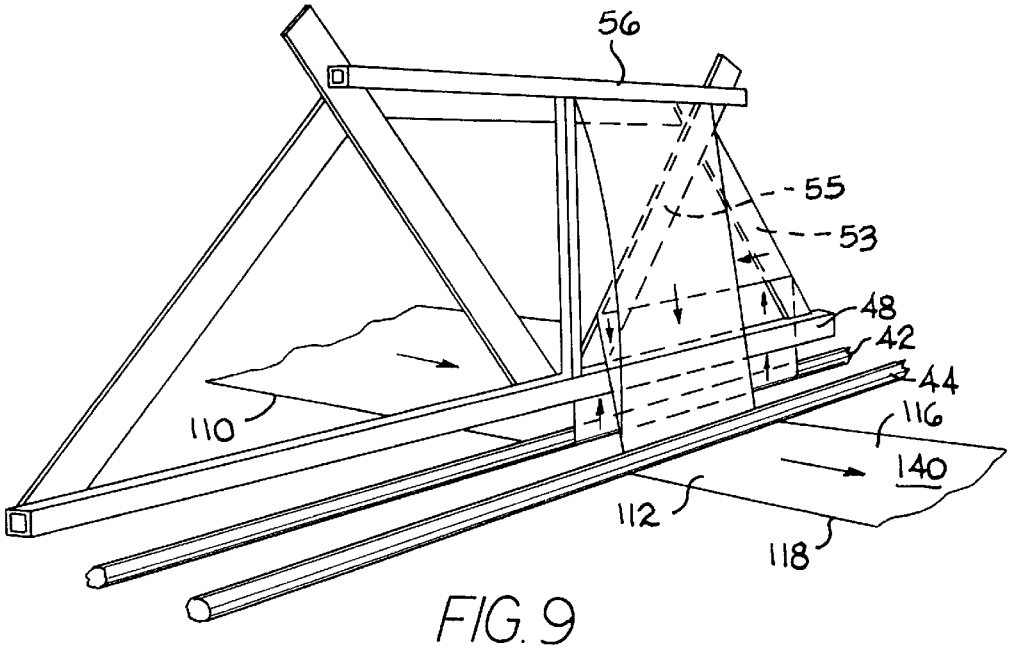
FIG. 9 shows a sheet of fabric being folded on a second side of a folding unit.

FIGS. 8 and 9 show a sheet of material 110 being folded on each half of the unit 46. As shown in FIG. 8, the sheet 110 is fed under the first alignment bearing shaft 42, behind or upstream of the base 48, and then is fed over the first leg 51 and the top piece 52 of the first structure. The section of the sheet 110 that passes over the first leg 51 is threaded over the internal bar 54 (i.e., the sheet is passed behind the bar 54, and then is folded over the bar 54), and registers with the section of the sheet 110 that passed over the top piece 52. The two sections of sheet then move downward simultaneously as depicted by respective arrows 110*a* and 110*b*. Both sections are then pulled under the second alignment bearing shaft 44. The result is the folded sheet 112 defined by a top section 140, a bottom section 142, a fold 116, and open edges 118 opposite the fold. If approximately the same amount of material is passed over the first leg 51 and the top piece 52, the sheet will be folded substantially in half, that is, the width of the top section 140 will be approximately equal to the width of the bottom section 142, as illustrated in FIGS. 8 and 9. If more material is passed over the first leg 51 than over the top piece 52, the sheet will be folded such that the bottom section 142 will be wider than the top section 140.

FIG. 9 is similar to FIG. 8 except that the sheet 110 passes over the second leg 53 instead of the first leg 51. This orientation change causes the fold 116 in the folded sheet 112 to be on the opposite side relative to that shown in FIG. 8.

Figure 10:
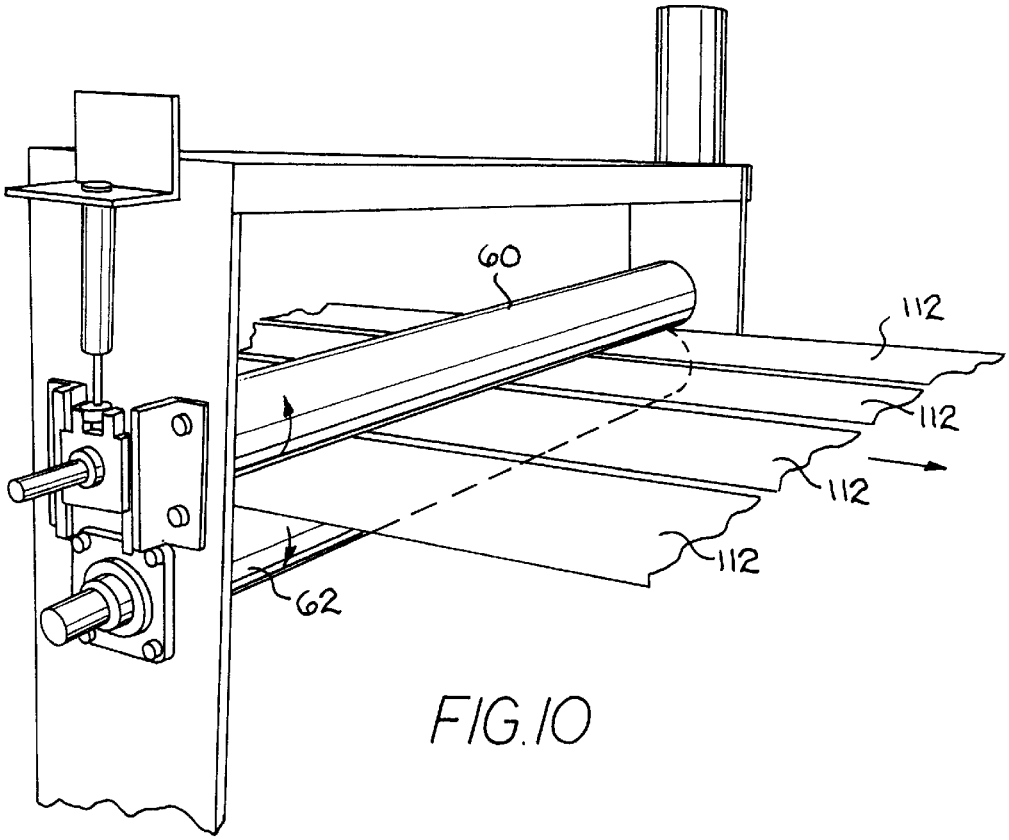
FIG. 10 shows pinch feed rollers pulling four sheets of folded fabric.
Figure 11A:
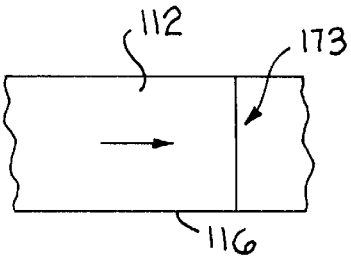
FIG. 11 is a drawing showing different styles of heat seals made in accordance with the present invention.
Figure 11B:
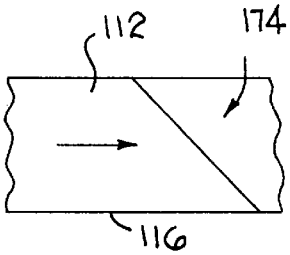
Figure 11C:
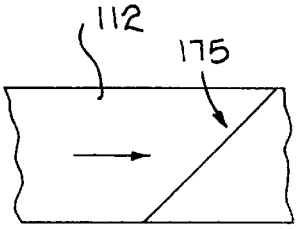
Figure 11D:
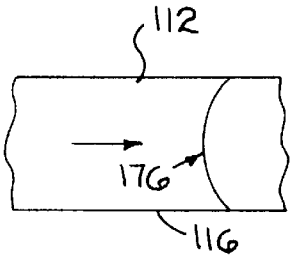
Figure 11E:
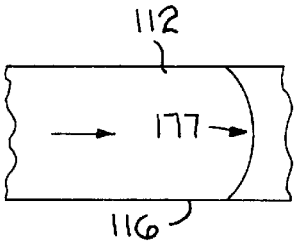
Figure 11F:
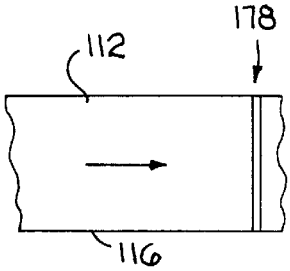

The folded sheet 112 is pulled by a pair of pinch feed rollers 60, 62 away from the folding station 40 and moved toward the heat sealing unit 70 and the perforating unit 80. FIG. 10 shows the pinch feed rollers 60, 62 with four folded sheets. The rollers 60, 62 are belt-driven and the speed of the rollers 60, 62, is regulated by inverter controls, with the start-stop sequencing of the inverter controls regulated by the microprocessor 99. Because the pinch feed rollers 60, 62 actually pull the folded sheet 112 from the folding station 40, the speed at which the folded sheet 112 travels through the pinch feed rollers 60, 62 determines the speed at which the unfolded sheet 110 is being fed to the folding station 40 from the feeder rolls 120.

After passing through the pinch feed rollers 60, 62, the folded sheets 112 reach a first stop position with material in the heat sealing unit 70 and the perforating unit 80. Substantially simultaneously, a first heat-seal 170 is made across the sheets 112 and the sheets 112 are perforated. As shown in FIG. 1, for each sheet, the heat-seal 170 is positioned upstream relative to the perforations 180. The sheets are then moved downstream by a distance equal to the length of the opening for the pouch where objects can be inserted into the pouch, or an insert distance 160, to a second stop position. At the second stop position, a second heat-seal 172 is made across the sheets 112. The sheets 112 are moved downstream by a distance equal to the length of the total edge allowance 162—the combined length allowed for material from the heat seals to the perforations on both sides of the pouch. The forward movement of the folded sheets 112 is then stopped at the first stop position. The first stop-move-second stop-move steps are controlled by microprocessor 99 and are repeated until the desired number of pouches have been produced. The microprocessor 99 also controls the timing sequences for making the heat seals 170, 172 and the perforations 180.

The heat seals 170, 172 are made by welding the material using heat and pressure, and can be made using any known sealing method that will cause the material to bond to itself in the seal area. Some examples of seals that can be made in accordance with the present invention are shown in FIG. 11: the seal may be substantially perpendicular 173 to the fold 116 or it may be at any other angle relative 174, 175 to the fold. It is anticipated that the seal can be essentially linear 173, 174, 175 or it can have curvature 176, 177 and the width of the seal can vary as necessary for the application. In addition, the seal may be created by more than one weld line 178.

The material can be perforated 180 using any known means, such as knife perforation, that will puncture all layers of sheet 112 and allow for easy separation of the individual units, without snagging or ripping the material.

Figure 12:
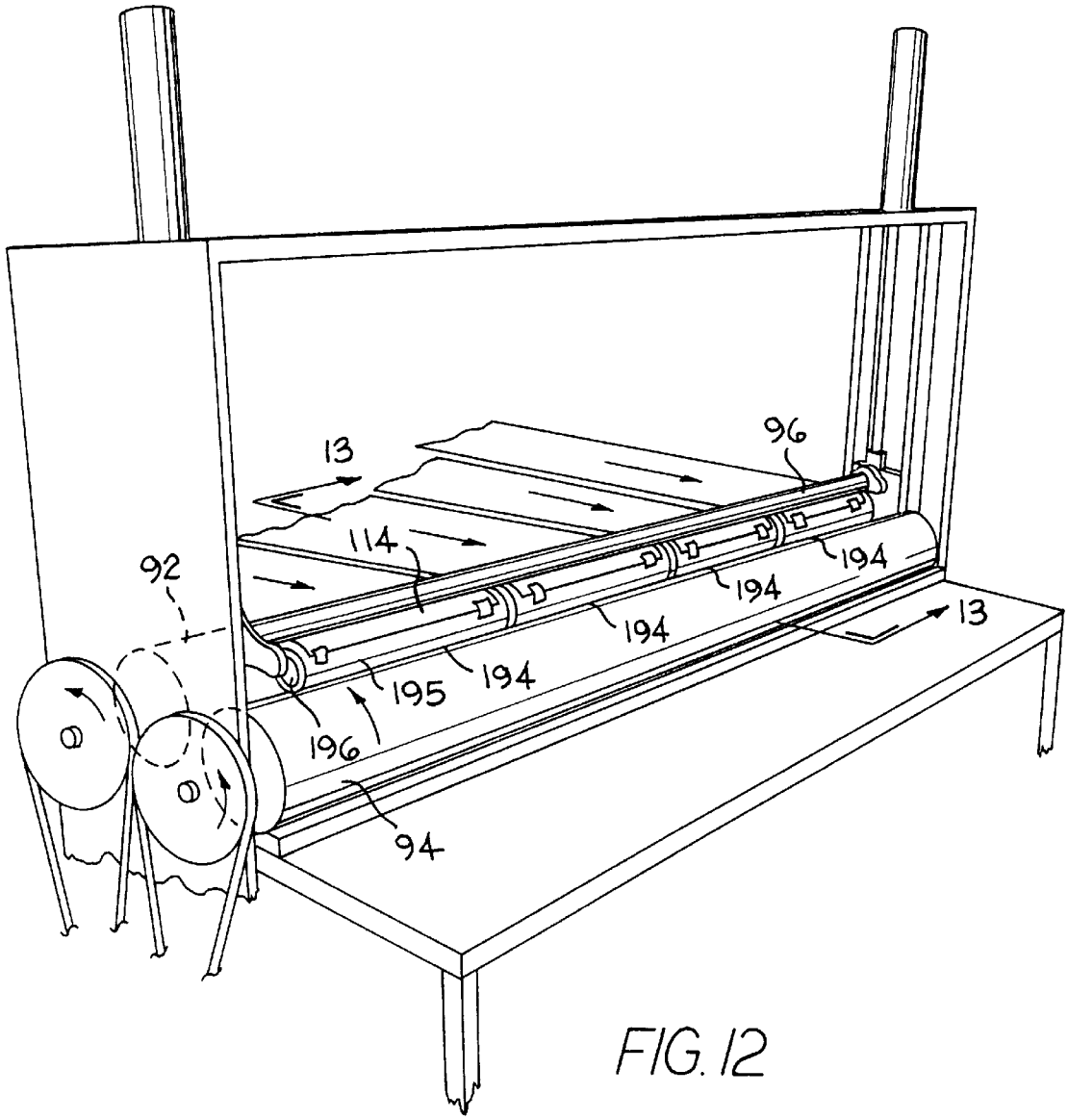
FIG. 12 is a view of the rewind reel station with four cores and the leading edges of four sheets of material attached to the cores.
Figure 13:
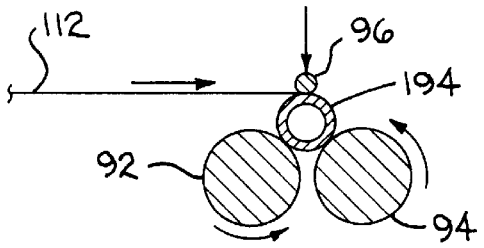
FIG. 13 is a cross-sectional view of the rewind reel station.

The interconnected pouches are collected on rolls at the rewind reel station 90. FIG. 12 shows the rewind reel station with four cores 194, each having an exterior 195 and an interior 196, mounted on top of a pair of variable speed rollers 92, 94, and the leading edge 192 of each folded sheet 112 affixed to a core exterior 195. The leading edge 192 can be affixed to the core exterior 195 by any means that will reversibly hold the material to the core, such as tape, putty, glue, adhesive, and the like. As shown in FIG. 13, the cores 194 are held against the variable speed rollers 92, 94, and the folded sheet 112 is pressed against the cores 194 by a tension bar 96. The cores 194 are rotated in the forward direction by the variable speed rollers 92, 94, and the folded sheet is collected on the rewind rolls 198. The speed at which the rewind rolls 198 collect the sheet 112, and indirectly the speed at which the sheet 112 is pulled from the heat sealing station 70, is determined by the speeds of the variable speed rollers 92, 94. The speeds of the variable speed rollers 92, 94, are regulated by inverter controls, with the start-stop sequences of the inverter controls regulated by microprocessor 99. To prevent inadvertent separation of the pouches along the perforations, the speeds of the variable speed rollers 92, 94 must vary slightly relative to each other, with roller 92 being slightly faster than roller 94. The variable speed rollers 92, 94 can be stopped when the rewind rolls reach a predetermined diameter or when a predetermined number of pouches have been collected to allow the filled rolls to be removed and replaced with empty cores.

It will be obvious to those skilled in the art that many modifications may be made to the embodiments described herein without departing from the scope of the present invention.

What is claimed is:

1. An apparatus for forming a roll of separable pouches from a continuous sheet of single-ply heat sealable material, said apparatus defining an upstream direction and a downstream direction, comprising:

(a) a feeder roll station, supplying said continuous sheet of heat-sealable material;

(b) a folding station, downstream from said feeder roll station, where said sheet is folded into two layers along a line essentially along the length of said sheet such that an edge of one layer is juxtaposed against the other layer;

(c) a pair of pinch feed rollers, downstream from said folding station;

(d) a heat sealing unit, downstream from said pinch feed rollers;

(e) a perforating unit, downstream from said pinch feed rollers;

(f) a rewind station, downstream from said perforating unit, including at least two variable speed rollers; and (g) a programmable control unit for controlling the operations of stations (a)–(f), wherein:

(1) said control unit causes said pinch feed rollers to rotate in a forward direction so as to pull said heat sealable sheet downstream from said feeder roll station and through said folding station; then said control unit causes said pinch feed rollers to rest, thereby stopping further movement of said sheet from said feeder roll station; and then said control unit signals the pinch feed rollers to alternate the rotation and rest actions; and (2) said control unit signals said variable speed rollers to pull said sheet downstream through said heat sealing unit and through said perforating unit and onto a rewind roll at said rewind station, said control unit causing said variable speed rollers to move said sheet downstream by a first distance where said control unit causes said heat sealing unit to make a first heat seal across the layers and said control unit causes said perforating unit to essentially simultaneously perforate the layers a fixed distance from said first heat seal; then said control unit causes said variable speed rollers to move said sheet downstream by a second distance where said control unit causes said heat sealing unit to make a second heat seal across the layers; and then said control unit causes said variable speed rollers to move said sheet downstream and onto said rewind roll by alternating first and second distances.

2. The apparatus of claim 1, wherein the folding station comprises:

(a) an upstream alignment bearing bar and a downstream alignment bearing bar; and (b) a folding unit positioned between said alignment bearing bars, and being defined by:

a base, having a length;

an angled frame, attached to said base to form a trapezoidal structure, said frame including:

first and second end sections; and a center section, having a length shorter than said base, and being positioned between said first and second end sections; and a second frame, attached to said base and substantially parallel to said angled frame, said second frame including:

a vertical bar, having a top end and a base end, said base end attached to said base;

a top bar, having a first end and a second end, attached to said top end of said vertical bar, and being substantially parallel to said base and substantially parallel to said center section of said angled frame;

a first leg, attached to said first end of said top bar and to said base, said first leg forming an angle of less than about 90° with said top bar; and a second leg, attached to said second end of said top bar and to said base, said second leg forming an angle of less than about 90° with said top bar.

3. The apparatus of claim 1, wherein said pinch feed rollers further include an inverter control responsive to said control unit for controlling the rate of rotation of said pinch feed rollers.

4. The apparatus of claim 1, wherein said rewind station further includes an inverter control responsive to said control unit for controlling the rate of rotation of said variable speed rollers.

5. The apparatus of claim 1, further comprising a means for feeding sheets of heat sealable material to said folding station.

6. The apparatus of claim 5, said means for feeding sheets of material further including a brake.

* * * * *